US005630651A

United States Patent [19]

Fishbane

[11] Patent Number: 5,630,651

[45] Date of Patent: May 20, 1997

[54] PRESSURE ADJUSTABLE CERVICAL PILLOW WITH LATERAL SIDES

[76] Inventor: Bruce M. Fishbane, 1040 Bimini La., Singer Island, Fla. 33404

[21] Appl. No.: 358,527

[22] Filed: Dec. 19, 1994

[51] Int. Cl.[6] ..... A47C 7/38

[52] U.S. Cl. ..... 297/397; 297/391; 5/644; 5/710

[58] Field of Search ..... 297/391, 397; 5/454, 653, 654, 644, 633, 655, 710

[56] References Cited

U.S. PATENT DOCUMENTS

| | | | |
|---|---|---|---|
| 969,251 | 1/1910 | Denzer | 297/397 |
| 2,822,554 | 2/1958 | Wenzelberger | 5/644 |
| 2,940,088 | 6/1960 | Boos | 5/338 |
| 4,206,945 | 6/1980 | Kifferstein | 297/220 |
| 4,218,792 | 8/1980 | Kogan | 297/391 |
| 4,320,543 | 3/1982 | Dixon | 5/434 |
| 4,383,713 | 5/1983 | Roston | 297/219 |
| 4,393,530 | 7/1983 | Stark | 5/437 |
| 4,415,203 | 11/1983 | Cawley | 297/391 |
| 4,424,599 | 1/1984 | Hannouche | 5/436 |
| 4,494,261 | 1/1985 | Morrow | 5/436 |
| 4,513,462 | 4/1985 | Thomas | 5/442 |
| 4,518,198 | 5/1985 | Daniels | 297/229 |
| 4,850,068 | 7/1989 | Walpin | 5/434 |
| 4,862,536 | 9/1989 | Pruit | 5/432 |
| 4,876,755 | 10/1989 | Parrish | 5/431 |
| 5,018,231 | 5/1991 | Wang | 5/436 |
| 5,046,205 | 9/1991 | Garcia | 5/654 |
| 5,048,136 | 9/1991 | Popitz | 5/431 |
| 5,079,785 | 1/1992 | Garcia | 5/654 |
| 5,129,705 | 7/1992 | Wray | 297/397 |
| 5,220,700 | 6/1993 | Liu | 5/636 |
| 5,231,720 | 8/1993 | Benoff | 5/644 |
| 5,363,524 | 11/1994 | Lang | 5/644 |

*Primary Examiner*—Peter M. Cuomo
*Assistant Examiner*—Anthony D. Barfield
*Attorney, Agent, or Firm*—Pennie & Edmonds

[57] ABSTRACT

A cervical pillow is disclosed comprising a headrest portion, a cervical neck roll portion, and opposing lateral side portions. The headrest portion and the cervical neck roll portion comfortably supports the user's head area while providing proper cervical support to the user's neck area. The opposing lateral side portions provide side support for the user's head, maintaining the user's head in a straight and anatomically correct position while the user's head is at rest in the cervical pillow. The cervical pillow has air bladders in the headrest, cervical, and lateral support portions for adjusting the amount of pressure against the head and cervical areas of the user. The cervical pillow has resilient cushion inserts between the air bladders and the surfaces that make contact with the user. The cushion inserts are held into place with a fabric material covering the cervical pillow assembly.

4 Claims, 2 Drawing Sheets

PRESSURE ADJUSTABLE CERVICAL PILLOW WITH LATERAL SIDES

TECHNICAL FIELD

This invention relates to cervical pillows, and more specifically, to cervical pillows for promoting proper posture and support for a person's head and cervical areas while the person is at rest in a sitting or a supine position.

BACKGROUND OF THE INVENTION

The cervical portion of the human spine has a generally natural concave posteriorly shape as viewed from the side, otherwise known as the Lordotic Curve. Prolonged unnatural cervical positions may cause fatigue and strain upon the cervical ligaments, joints, and discs, and as a result, the increased demand on the cervical muscles may lead to pain and tension in the neck area and tension headaches in the head area. Prolonged exposure to unnatural cervical positions may decrease the range of motion of the cervical vertebrae by provoking inflammation, tightening the ligaments, and affecting the neck muscles by providing protective contraction.

The neck muscles and ligaments provide the upright support to the head. When the muscles are fatigued or artificially extended, the ligaments, joints, and discs provide the sole upright support to the head. When head and neck movement is restricted by protective muscle tension and/or inflammation, ligament strain results producing pain. Ligamentous laxity and aberrant muscle activity alter the integrity of the disc and vertebral segments that may produce degenerative changes or transient inflammation to the cervical portion of the spine. Compressive forces of muscular contraction, in combination with disc degeneration, may result in aberrant neuronal, vascular, and lymphatic alterations predisposing the vertebral joints to arthritic changes and articular damage.

Cervical pillows of many variety have attempted to provide the user with comfort as well as proper orthopedic support to the head and cervical areas. Some prior art cervical pillows are designed and intended for use while the user is lying in the supine position. Yet other prior art cervical pillows are designed and intended for use while the person is sitting in an upright position.

U.S. Pat. No. 4,424,599 issued to Hannouche discloses a cervical pillow to provide corrective support to the user's neck, head, and shoulder areas while the user is lying in a supine position. The pillow has a shoulder engaging portion, an occiput engaging portion, and a neck engaging portion therebetween. The pillow may only be used in a supine position since the pillow utilizes the weight of the person's head and shoulders to engage the neck engaging portion.

U.S. Pat. No. 5,018,231 issued to Wang discloses a contoured pillow for use while a person is sleeping in a supine position or lying in a side position.

U.S. Pat. No. 5,220,700 issued to Liu discloses a protective pillow for supporting the head of the user. The pillow has side panels with hooks that engage and fasten to the user's shoulders while the user is sitting in a seat or lying in a supine position.

U.S. Pat. No. 5,129,705 issued to Wray discloses a rigid headrest to support a person's head while the person is seated upright in a seat. The headrest is mechanically mounted onto the seat-back.

A cervical pillow that provides support to the user's head and cervical areas, that may be used in supine or sitting positions, that is easily portable from one location to the other, and that has support portions that are pressure adjustable is what is needed.

DISCLOSURE OF THE INVENTION

It is, therefore, an object of the present invention to provide a cervical pillow that provides support and cushion to the user's head and cervical areas, whether the user is lying in a supine position or in a sitting position in a seat having a seat-back.

It is another object of the present invention to provide a cervical pillow having lateral sides to maintain the user's head in an anatomically correct and straight position if the user is lying in a supine position or if in a sitting position to reduce overextension or excessive lateral bending of and cramps in the cervical muscles while the pillow is used for short or extended periods, such as, when the user is sleeping or when the user is recuperating from a cervical injury or cervical surgery.

It is another object of the present invention to provide a cervical pillow that is easily collapsible and portable from one location to another making the portability of the pillow an attractive feature for the weary traveler.

It is another object of the present invention to provide a cervical pillow that has a cervical portion, a head rest portion, and opposing lateral side portions wherein each portion may be adjusted pneumatically to vary the pressure of each portion to rest against the user's head and cervical areas.

It is another object of the present invention to provide a cervical pillow that has fastening straps so that the pillow may be utilized with a variety of seats having a seat-back, such as, automobile seats, household seats, loungers, recliners, airline seats, and commuter train seats, so that the pillow may be utilized without the pillow changing position relative to the seat and the user while the pillow is in use.

According to the present invention, a cervical pillow is disclosed comprising a headrest portion, a cervical neck roll portion, and opposing lateral side portions. The cervical neck roll portion may be used to support the user's cervical area as the occiput portion of the user's head is rested against the headrest portion. The cervical neck roll portion is positioned at the bottom of the headrest portion. The opposing lateral side portions are located perpendicularly and juxtaposed in relation to the cervical neck roll and headrest portions.

The headrest portion and the cervical neck roll portion comfortably supports the user's head area while providing proper cervical support to the user's cervical area. The opposing lateral side portions provide side support for the user's head, maintaining the user's head in a straight and anatomically correct position while the user's head is at rest in the cervical pillow.

The cervical pillow includes adjustable fastening straps with hook and loop fasteners, snaps, buckles, or other suitable fastening means so that the pillow may be utilized with and fastened to any seat having a seat-back. The adjustable fastening strap allows the user to position the cervical pillow on an existing seat or chair, such as an automobile or airline seat. The cervical pillow may also be completely integrated into a seat providing the cervical support advantages of this disclosure to a seat as a permanent feature.

The cervical pillow may be made from any resilient material that provides cushion and support to the user's head and cervical areas. In one embodiment, the cervical pillow has air bladders in the headrest, cervical, and lateral support portions to provide means for adjusting the amount of pressure against the head and cervical areas of the user. The series of air bladders provide a cervical pillow that may be easily inflated and deflated by the user, and therefore, makes the cervical pillow easily adjustable, portable, and compact. Further yet, each portion of the cervical pillow may be made with a separate air bladder so that a valve and plumbing arrangement may control the amount of pressure inside of each said portion.

The cervical pillow has resilient cushion inserts between the air bladders and the surfaces that make contact with the user. The cushion inserts are held into place with a fabric material covering the cervical pillow assembly. The cervical pillow made from air bladder portions covered with a layer of resilient cushion material provide the user with comfort as well as a portable cervical pillow that may be pressure adjusted against the user's head and cervical areas.

The foregoing and other advantages of the present invention will become more apparent from the following description and accompanying drawings.

BEST MODE FOR CARRYING OUT THE INVENTION

Figure 1:
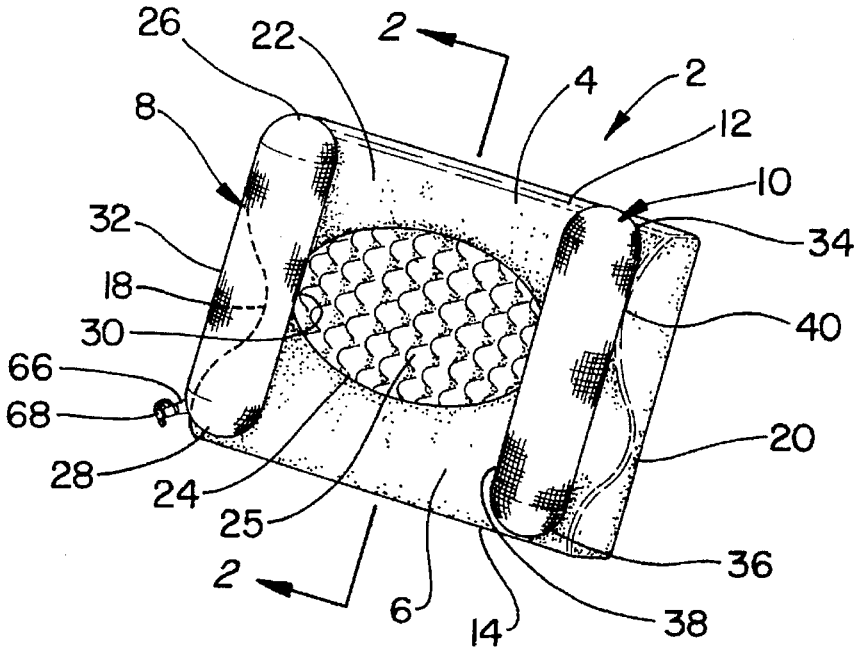
FIG. 1 is a perspective view of a cervical pillow of the present invention having lateral sides.
Figure 2:
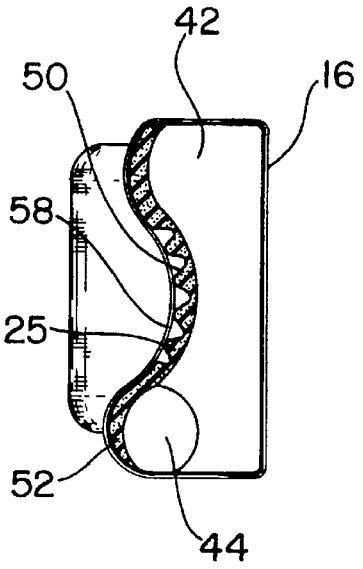
FIG. 2 is a cross sectional view of the present invention taken along line 2—2 of FIG. 1.
Figure 3:
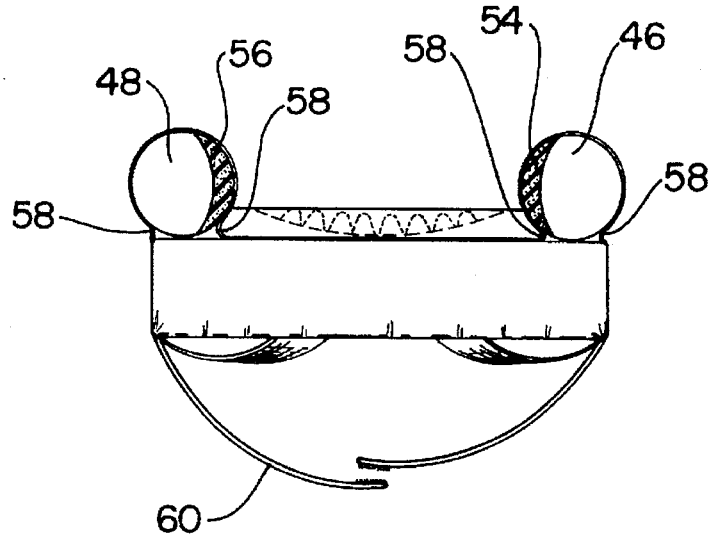
FIG. 3 is a top view of the present invention.

As shown in FIG. 1, FIG. 2, and FIG. 3, a cervical pillow 2 has a headrest portion 4, a cervical roll portion 6, a first lateral support 8, and a second lateral support 10. The generally square or rectangular shaped headrest portion 4 has a top edge 12 and a bottom edge 14 extending from a posterior side 16 that are parallel in relation to each other and spaced apart to define the height of the pillow 2. The headrest portion also has a first lateral side 18 and a second lateral side 20 extending from the posterior side 16 that are parallel in relation to each other and perpendicular to the top and bottom edges 12 and 14. The lateral sides 18 and 20 are spaced apart from each other to define the width of the pillow 2.

The cervical roll portion 6 is adjacent and parallel to the bottom edge 14. The cervical roll portion 6 is generally cylindrical in shape and extends the width of the headrest portion 4 and has a diameter of the proper size to provide the proper amount of support to the user's cervical area.

The headrest portion 4 has an occiput cavity 24 defined by a ridge 22 that is adjacent and parallel to the top edge 12 and the cervical roll portion 6. The occiput cavity 24 is elliptically shaped and is lengthwise parallel to the cervical roll portion 6 and the top and bottom edges 12 and 14. The occiput cavity 24 extends the width of the headrest portion 4 and has the proper dimensions to provide the proper amount of support to the user's posterior head area. The occiput cavity 24 may be filled with a layer of sculptured foam 25 for even weight distribution of the user's head while resting in the occiput cavity 24.

The first lateral support 8 is generally cylindrical in shape and has a top edge 26, a bottom edge 28, an inside surface 30, and an outside surface 32. The inside surface 30 is juxtaposed to the headrest portion first lateral side 18. The first lateral support top edge 26 is adjacent to the headrest top edge 12, with the first lateral support bottom edge 28 being adjacent to one end of the cervical roll portion 6.

The second lateral support 10 is generally cylindrical in shape and has a top edge 34, a bottom edge 36, an inside surface 38, and an outside surface 40. The inside surface 38 is juxtaposed to the headrest portion second lateral side 20. The second lateral support top edge 28 is adjacent to the headrest top edge 12, with the second lateral support bottom edge 28 being adjacent to one end of the cervical roll portion 6.

The cervical pillow 2 has means to inflate and deflate the pillow 2 and to adjust the pressure inside of the cervical pillow portions. In one embodiment, the cervical pillow portions each have an internal air bladder to accomplish this means.

The headrest portion 4 has an internal air bladder 42 extending the length and width of the headrest portion 4. The cervical roll portion 6 has an internal air bladder 44 extending the length of the cervical roll portion 6 and has a diameter proportional to fit inside the cervical roll portion 6. The lateral supports 8 and 10 each have a corresponding air bladder: a first lateral support internal air bladder 46 and a second lateral support internal air bladder 48.

The cervical pillow portions have resilient cushions located between the air bladders and the surfaces that contact the user. The head rest portion 4 has a head rest cushion 50 located over the headrest air bladder 42 covering the headrest ridge 22 and the occiput cavity 24. A cervical roll cushion 52 is located over the cervical roll portion air bladder 44 and juxtaposed to the head rest cushion 50. A first lateral support cushion 54 is located over the first lateral support air bladder 46 and adjacent to the first lateral support inside surface 30. A second lateral support cushion 56 is located over the second lateral support air bladder 48 and adjacent to the second lateral support inside surface 40. The cushions may be held into place against the air bladders by a comfortable fabric covering 58. The fabric covering 58 may also help to hold into place the first and second lateral supports 8 and 10. The fabric covering 58 may be sewn into place around the pillow portions, encompassing the entire pillow to give the pillow a comfortable feel against the user's skin and to protect the air bladders during use and storage.

Figure 4:
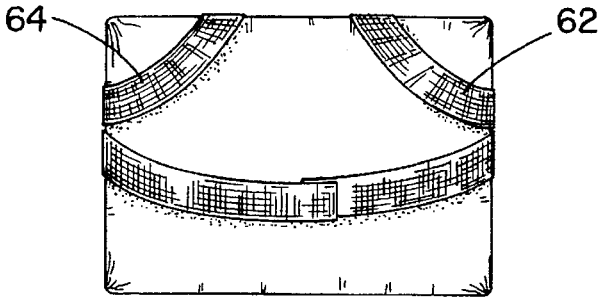
FIG. 4 is a back view of the present invention showing the fastening straps.

As shown in FIG. 4, the pillow 2 has a lateral fastening strap 60 extending laterally across the posterior side 16. The fastening strap 60 utilizes hook and loop fasteners or other fastening means, such as, buttons, snaps, etcetera, so that the pillow may be fastened to and adjusted around an existing seat having a seat-back when the pillow 2 is to used in the sitting or reclining position. The pillow 2 also has a first diagonal fastening strap 62 and a second diagonal fastening strap 64. The diagonal straps 62 and 64 are attached to the pillow posterior side 16; one end of each strap attached to the headrest top edge 12 and the end of the first strap 62 attached to the headrest first lateral side 18 and the end of the second strap 64 attached to the headrest second lateral side 20. The diagonal straps 62 and 64, in combination with the lateral fastening strap 60, allow the pillow 2 to be fastened to a wide variety of seats having seat-backs. Some seats have a square seat-back, like those found in airline first class seating, and other seats have a tapered seat-back, like captain seats used in conversion vans. The straps may be used in conjunction with each other, or the lateral fastening strap 60 may used while the diagonal straps 62 and 64 are sandwiched between the pillow 2 and the seat-back.

In one embodiment, the air bladders have an internal passageway and are connected so that the air bladders are inflated and deflated by a conveniently located conventional air valve stem 66 with a plug 68. The air valve stem 66 may be located at any location that would allow the user to comfortably utilize the pillow 2 without intrusion from the air valve stem 66. The air valve may be located either at the first or the second lateral support facing forward so that the user may inflate the pillow 2, fasten the pillow 2 to the seat-back, if applicable, then sit down and rest the head and cervical areas into the pillow 2. Then, the user may slowly deflate the pillow 2 until the maximum comfort level for the user is obtained and then the plug 68 is placed into the valve stem 66.

Figure 5:
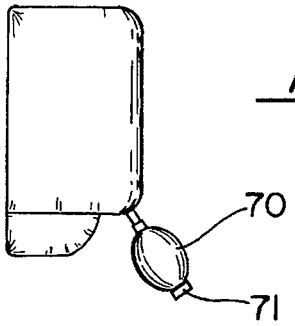
FIG. 5 is side view of a separate embodiment the present invention showing a bulb to adjust the pressure inside the cervical pillow.

In a separate embodiment, and as shown in FIG. 5, a bulb valve 70 connecting to the valve stem 66 at one end and having an air release mechanism 71 at the other end, similar to a blood pressure bulb. The bulb 70 is used to pressurize the pillow air bladders and may be used while the user's head and neck are resting in the pillow. The bulb 70 and valve stem 66 are conveniently located at the lateral support bottom edge 28, for right handed users, or at the opposite lateral support bottom edge 36 for left handed users, and angled forward so that the user will have easy access to the bulb with their hand, whether the user is using the pillow while sitting or lying down. The bulb release mechanism 71 then may be used to release air from the air bladders, adjusting the pressure in the pillow air bladders to maximize the comfort level of the pillow for the user. The bulb release mechanism 71 is then closed to maintain the desired air pressure in the pillow. The bulb 70 may have means for fastening the bulb 70 to the valve stem 66, such as external threads on the valve stem 66 and internal threads on a coupling attached to the bulb valve. Therefore, the bulb 70 may be fastened to the stem 66, the pillow pressurized to the user's comfort, and then the bulb 70 unfastened from the stem 66. Then the bulb 70 may be stored away.

Figure 6:
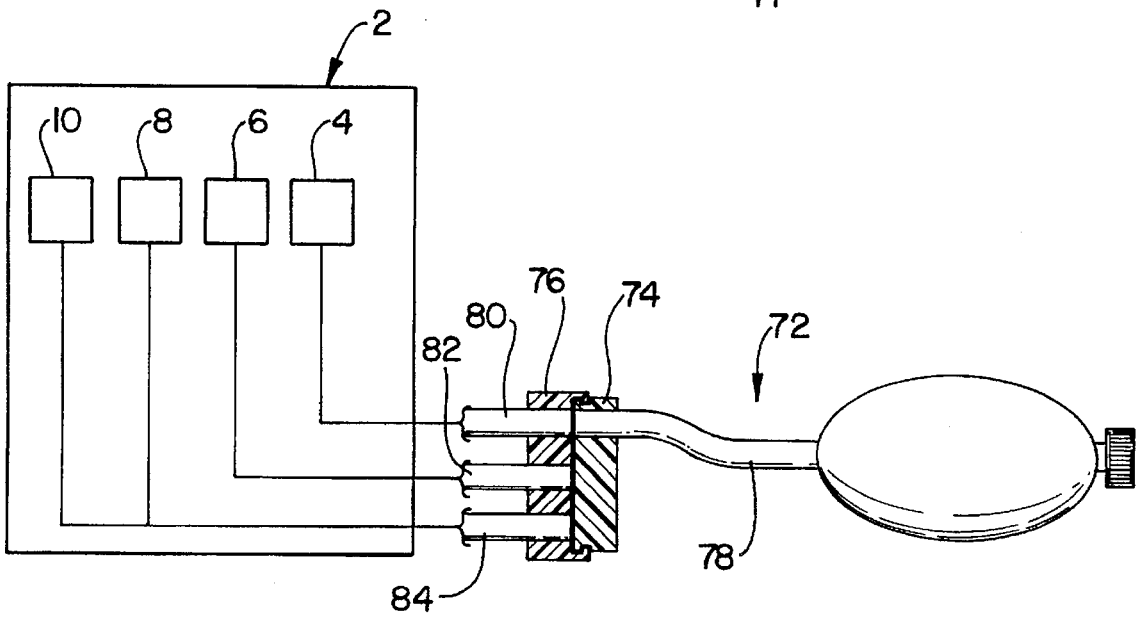
FIG. 6 is a partial sectional view of a valve of a separate embodiment of the present invention.

In yet a separate embodiment, and as shown in FIG. 6, the pillow is essentially the same as described above except that the pillow has means to individually pressurize and depressurize the individual air bladders in the pillow. A bulb air valve 72 assembly is used having a rotatable member 74 and a stationary member 76. The rotatable member 74 houses a pliable valve stem 78 extending from the bulb and the stationary member 76 houses tubing extending to each of the pillow portions. A first tube 80 provides a passageway to the headrest portion 4. A second tube 82 provides a passageway to the cervical roll portion 6. A third tube 84 is bifurcated and provides a passageway to each of the lateral supports 8 and 10. The bulb release mechanism may be used to release air, or depressurize the air bladders to adjust the air bladders to the user's comfort level.

The headrest portion and the cervical neck roll portion comfortably supports the user's head area while providing proper cervical support to the user's neck area. The opposing lateral side portions provide side support for the user's head, maintaining the user's head in a straight and anatomically correct position while the user's head is at rest in the cervical pillow.

The cervical pillow may be made from any resilient material that provides cushion and support to the user's head and neck areas. The cervical pillow may be easily inflated and deflated by the user, and therefore, makes the cervical pillow easily adjustable, portable, and compact.

Although this invention has been shown and described with respect to a detailed embodiment, those skilled in the art will understand that various changes in form and detail may be made without departing from the spirit and scope of the claimed invention.

I claim:

1. A cervical pillow for supporting the head and cervical area of a person who is sitting in an existing seat or lying in a supine position comprising:

a headrest portion having a top edge, a bottom edge, a first lateral side and a second lateral side, the edges and the lateral sides extending from a posterior side, the edges being parallel in relation to each other and spaced apart to define the height of the pillow, the lateral sides being parallel in relation to each other and perpendicular to the edges and spaced apart to define the width of the pillow, so that the headrest portion is generally rectangular in shape;

a cervical roll portion being adjacent and parallel to the bottom edge and extending the width of the headrest portion, the cervical roll portion being generally cylindrical in shape and having a diameter to provide support to the user's cervical area;

the headrest portion having a ridge adjacent and parallel to the top edge and an occiput cavity defined by the ridge and the cervical roll portion, the occiput cavity is parallel to the cervical roll portion and the edges, the occiput cavity extending the width of the headrest, the occiput cavity being adapted to provide support to the user's occiput area;

a first lateral support being generally cylindrical in shape and having an inside surface and an outside surface, the first lateral support outside surface being juxtaposed to the headrest portion first lateral side and extending from headrest portion;

a second lateral support being generally cylindrical in shape and having an inside surface and an outside surface, the second lateral support outside surface being juxtaposed to headrest portion second lateral side and extending from the headrest portion, so that the opposing lateral side portions provide side support for the user's head, maintaining the user's head in a straight ananatomically correct position while the use's head is at rest in the cervical pillow;

a headrest air bladder internal of the headrest portion;

a cervical roll air bladder internal of the cervical roll portion;

a first lateral support air bladder internal of the first lateral support;

a second lateral support air bladder internal of the second lateral support;

means for adjusting the pressure inside of the pillow portions comprising:

a bulb having a release valve and a pliable valve stem;

a rotatable member having a groove and a stationary member having a lip, the rotatable member groove being in rotating contact with the stationary member lip;

a first tube passageway extending from the stationary member to the headrest portion;

a second tube passageway extending from the stationary member to the cervical roll portion;

a third tube passageway bifurcated and extending from the stationary member to the first and second lateral supports, the rotatable member housing the pliable valve stem, the stationary member housing the first, second, and third tubes so that the rotatable member is aligned with one passageway and the bulb is used to pressurize and depressurize the connected pillow to the user's comfort preference.

2. The cervical pillow of claim 1 wherein the bulb has means for fastening to the valve stem so that the bulb may fastened to the valve stem to adjust the pressure in the pillow and then unfastened from the valve stem and stored away while the pillow is in use.

3. A cervical pillow for supporting the head and neck area of a person who is sitting in an existing seat or lying in a supine position, comprising:

a headrest portion having a top edge, a bottom edge, a first lateral side and a second lateral side, the edges and the lateral sides extending from a posterior side, the edges being parallel in relation to each other and spaced apart to define the height of the pillow, the lateral sides being parallel in relation to each other and perpendicular to the edges and spaced apart to define the width of the pillow, so that the headrest portion is generally rectangular in shape;

a cervical roll portion being adjacent and parallel to the bottom edge and extending the width of the headrest portion, the cervical roll portion being generally round in shape and adapted to provide support to the user's cervical area;

the headrest portion having a ridge adjacent and parallel to the top edge and an occiput cavity defined by the ridge and the cervical roll portion, the occiput cavity is parallel to the cervical roll portion and the edges, the occiput cavity extending the width of the headrest portion, the occiput cavity being adapted to provide support to the user's occiput area;

first lateral support being generally cylindrical in shape and having an inside surface and an outside surface, the first lateral support outside surface being juxtaposed to the headrest portion first lateral side and extending from headrest portion;

a second lateral support being generally cylindrical in shape and having an inside surface and an outside surface, the second lateral support outside surface being juxtaposed to the headrest portion second lateral side and extending from the headrest portion, so that the opposing lateral side portions provide side support for the user's head, maintaining the user's head in a straight and anatomically correct position while the user's head is at rest in the cervical pillow;

a fabric covering the cushions and the pillow;

a lateral fastening strap extending laterally across the posterior side, the fastening strap having hook and loop fasteners so that the fastening strap may be adjusted around an existing seat having a seat-back;

a first diagonal fastening strap;

a second diagonal fastening strap, the diagonal straps being attached to the pillow posterior side with one end of each diagonal strap attached to the headrest top edge and the end of the first diagonal strap attaching to the headrest first lateral side and the end of the second diagonal strap attaching to the headrest second lateral side;

a headrest air bladder internal of the headrest portion;

a cervical roll air bladder internal of the cervical roll portion;

a first lateral support air bladder internal of the first lateral support;

a second lateral support air bladder internal of the second lateral support;

a bulb having a release valve and a pliable valve stem;

resilient cushions being located between the air bladders and the surfaces that contact the user;

a rotatable member having a groove and a stationary member having a lip, the rotatable member groove being in rotating contact with the stationary member lip;

a first tube passageway extending from the stationary member to the headrest portion;

a second tube passageway extending from the stationary member to the cervical roll portion;

a third tube passageway being bifurcated and extending from the stationary member to the first and second lateral supports, the rotatable member housing the pliable valve stem, the stationary member housing the first, second, and third tubes so that the rotatable member is aligned with one passageway and the bulb pressurizes and depressurizes the connected pillow portion to the user's comfort preference.

4. A seat having a seat-back, the seat-back having an integrated cervical pillow for supporting the head and cervical area of a person who is sitting or reclining in the seat, the cervical pillow comprising:

a headrest portion having a top edge, a bottom edge, a first lateral side and a second lateral side, the edges and the lateral sides extending from a posterior side, the edge being parallel in relation to each other and spaced apart to define the height of the pillow, the lateral sides being parallel in relation to each other and perpendicular to the edges and spaced apart to define the width of the pillow, so that the headrest portion is generally rectangular in shape;

a cervical roll portion being adjacent and parallel to the bottom edge and extending the width of the headrest portion, the cervical roll portion being generally cylindrical in shape and having a diameter to provide support to the user's cervical area;

the headrest portion having a ridge adjacent and parallel to the top edge and an occiput cavity defined by the ridge and the cervical roll portion, the occiput cavity is parallel to the cervical roll portion and the edge, the occiput cavity extending the width of the headrest portion, the occiput cavity being adapted to provide support to the user's occiput area;

a first lateral support being generally cylindrical in shape and having an inside surface and an outside surface, the first lateral support outside surface being juxtaposed to the headrest portion first lateral side and extending from the headrest portion;

a second lateral support being generally cylindrical in shape and having an inside surface on an outside surface, the second lateral support outside surface being juxtaposed to the headrest portion second lateral side and extending from the headrest portion, so that the opposing lateral side portions provide side support for the user's head, maintaining the user's head in a straight and anatomically correct position while the user's head is at rest in the cervical pillow;

a headrest air bladder internal of the headrest portion;

a cervical roll air bladder internal of the cervical roll portion;

a first lateral support air bladder internal of the first lateral support;

a second lateral support air bladder internal of the second lateral support;

means for adjusting the pressure inside of the pillow portions comprising:

a bulb having a release mechanism and a pliable valve stem;

a rotatable member having a groove and a stationary member;

a rotatable member having a lip, the rotatable member groove being the rotatory contact with the stationary member lip;

a first tube passageway extending from the stationary member to the headrest portion;

a second tube passageway extending from the stationary member to the cervical roll portion;

a third tube passageway being bifurcated and extending from the stationary member to the first and second lateral supports, the rotatable member housing the pliable valve stem, the stationary member housing the first, second, and third tubes so that the rotatable member is aligned with one passageway and the bulb is used to pressurize and depressurize the connected pillow portion to the user's comfort preference.

* * * * *